US010081997B2

(12) United States Patent
Hern et al.

(10) Patent No.: US 10,081,997 B2
(45) Date of Patent: Sep. 25, 2018

(54) WATERMELON MILL WITH REPLACEABLE CUTTING STRUCTURE

(71) Applicant: BAKER HUGHES INCORPORATED, Houston, TX (US)

(72) Inventors: Gregory L. Hern, Porter, TX (US); Christopher R. Hern, Porter, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 327 days.

(21) Appl. No.: 14/944,995

(22) Filed: Nov. 18, 2015

(65) Prior Publication Data

US 2017/0138139 A1 May 18, 2017

(51) Int. Cl.
*E21B 29/06* (2006.01)
*E21B 17/042* (2006.01)

(52) U.S. Cl.
CPC ..... *E21B 29/06* (2013.01); *E21B 17/042* (2013.01)

(58) Field of Classification Search
CPC ..... E21B 29/06; E21B 29/00; E21B 29/005; E21B 7/06; E21B 7/061
See application file for complete search history.

(56) References Cited

U.S. PATENT DOCUMENTS 5,727,629 A 3/1998 Blizzard, Jr. et al.
6,138,761 A 10/2000 Freeman et al.
7,090,034 B2 * 8/2006 Rives ..... E21B 10/28 175/345
9,097,073 B2 8/2015 Schmidt et al.
2007/0256867 A1 11/2007 Degere et al.
2008/0093075 A1 * 4/2008 Toulouse ..... E21B 29/06 166/298
2013/0328275 A1 12/2013 Haimer
2016/0319617 A1 * 11/2016 Ghegadnnal ..... E21B 29/002

FOREIGN PATENT DOCUMENTS

WO 2014137315 A1 9/2014

* cited by examiner

*Primary Examiner* — Wei Wang
(74) *Attorney, Agent, or Firm* — Steve Rosenblatt

(57) ABSTRACT

A watermelon mill has a cutting structure mounted on a removable sleeve. The mandrel can be in two pieces threaded together to trap a ring or lug extending internally from the sleeve. Alternatively the sleeve can serve as a coupling holding together opposed threaded components that then make up the mandrel. The mandrel can have a radial external shoulder to act as a sleeve travel stop and another sleeve can be pushed into the first sleeve that has the cutting structure on it for proper axial fixation. The second sleeve that does not have cutting structure is pushed into position by making up an adjacent pin and box combination at a nearby connection to the cutting structure. What results is a flexible assembly that assembles without welding and retains greater flexibility in the larger sizes due to the assembly method. The sleeve can be tossed when the cutting structure is spent or redressed and remounted for another use.

19 Claims, 2 Drawing Sheets

WATERMELON MILL WITH REPLACEABLE CUTTING STRUCTURE

FIELD OF THE INVENTION

The field of the invention is subterranean mills and more particularly mills used to make a window through a tubular for a lateral exit where the cutting structure for the mill can be readily separated from a mill body for replacement

BACKGROUND OF THE INVENTION

Occasions arise where laterals are needed to extend from a main bore or another lateral to enhance production from a given formation. The process for doing this is usually to anchor and orient a whipstock that has a milling assembly associated with it when run in. The whipstock is a long body with a ramp that has to be oriented in the desired direction of the casing exit to be produced. Once the ramp is oriented as needed and the anchor is set the milling assembly is pushed down or pulled up to break away from a lug above the whipstock ramp. The milling assembly is then rotated to progress along the whipstock ramp surface and cut through the wall of the surrounding tubular to make a window. In multilateral applications, a tubular lateral is extended through the window with suitable seals to isolate the main bore and a lateral bore through the window made by the mills.

The milling assembly is a collection of two or more mills with a pilot mill leading followed by one or more elliptically shaped mills that lengthen the window made by the pilot mill. In the past the watermelon mill was a unitary construction of an elliptical shape on a tubular mandrel having upsets and threads at opposed ends to be made up into a tubular string for rotation to mill the window. These mills were subject to stress concentrations in the welded locations of the mill at the transition to the flexible shaft that extends from opposed ends. In larger sizes of watermelon mills the dimensional difference between the mandrel and the cutting structure diameter is far greater than in the smaller sizes making the welded transition between the mandrel and the cutting structure assembly a location for stress failure. In an effort to eliminate welding in the transition from the mandrel to the cutting structure and to make redressing the mills for reuse simpler, the present invention provides a cutting structure sleeve held in position in a variety of ways using threaded connections so that the assembly becomes more flexible to minimize or eliminate stress failures in the larger sizes and to make redressing the mill a simple matter of threaded connection disassembly. The components can be assembled in a variety of ways to accomplish these purposes and some options for such assemblies are described in the detailed description of the preferred embodiment and the associated drawings. Those skilled in the art will recognize, however, that the full scope of the invention is to be found in the appended claims.

Generally relevant to cutting structures detachable from mandrels and dropped in the hole are US 2007/0256867 and US 2013/0328275. U.S. Pat. No. 9,097,073 shows articulated blades that can be disassembled from a mill body.

SUMMARY OF THE INVENTION

A watermelon mill has a cutting structure mounted on a removable sleeve. The mandrel can be in two pieces threaded together to trap a ring or lug extending internally from the sleeve. Alternatively the sleeve can serve as a coupling holding together opposed threaded components that then make up the mandrel. The mandrel can have a radial external shoulder to act as a sleeve travel stop and another sleeve can be pushed into the first sleeve that has the cutting structure on it for proper axial fixation. The second sleeve that does not have cutting structure is pushed into position by making up an adjacent pin and box combination at a nearby connection to the cutting structure. What results is a flexible assembly that assembles without welding and retains greater flexibility in the larger sizes due to the assembly method. The sleeve can be tossed when the cutting structure is spent or redressed and remounted for another use. The sleeve can be threaded against a shoulder with a thread that is preferably tapered. The window mill can be attached to the watermelon mill with a double shoulder or internal shoulder connection.

DETAILED DESCRIPTION OF THE PREFERRED EMBODIMENT

Figure 1:
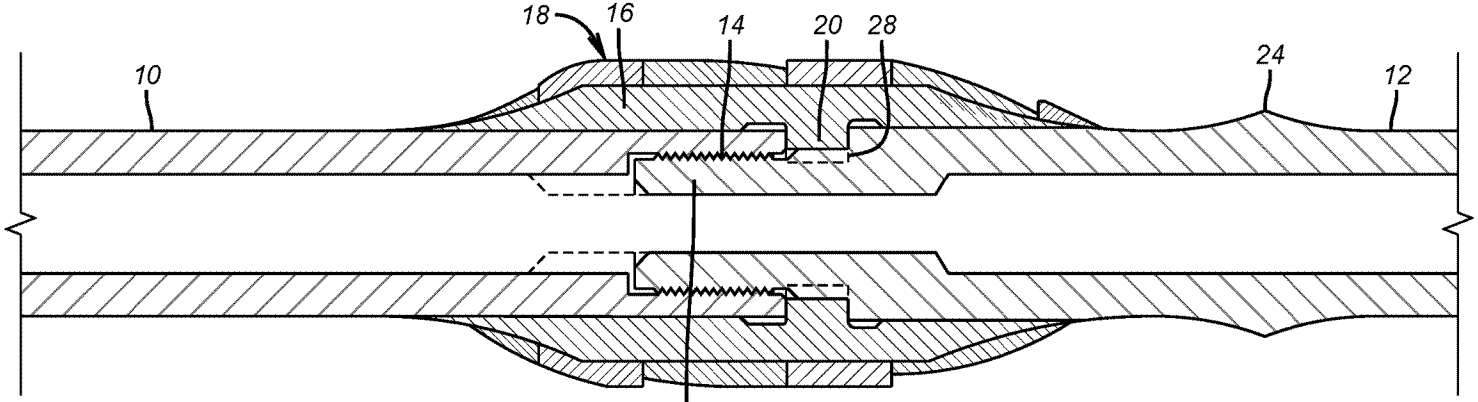
FIG. 1 a section view showing mandrel components fixating a sleeve on which the cutting structure is disposed.

FIG. 1 illustrates mandrel components 10 and 12 that are connected at thread 14. Threaded connection 14 is preferably located under sleeve 16 that has cutting structure 18 on its outer face. The sleeve 16 has an internal ring 20 that can be continuous for 360 degrees or can be in segments or it can be a plurality of spaced lugs that fixate sleeve 16 in the axial direction of arrow 22. As thread 14 is made up to specified torque, it captures ring or segments 20 and that in turn holds the sleeve 16 which has the cutting structure 18 on its outer surface secured in that location. While threaded connections are illustrated other connections are envisioned and different thread forms can be used in a single or multistep thread pattern. A pin in slot arrangement could be used. Bump 24 is there to avoid concentrating stress as components 10 and 12 bend as the milling assembly that can include multiple watermelon mills behind a window mill flex along the whipstock ramp to make the window. The use of a multi-component mandrel assembly such as 10 and 12 and the threaded connection between them provides enhanced flexibility to prevent stress failures during bending as the watermelon mills exit and widen the window in the known manner. The absence of welding on the mandrel also helps to alleviate areas of stress concentration. The sleeve 16 is readily removed after use by undoing thread 14. At that point the cutting structure 18 can be replaced in the known manner for adhering the cutting structure to the substrate which is the outer surface of sleeve 16. Alternatively, another sleeve 16 with cutting structure 18 can simply replace the original sleeve with worn cutting structure 18. In this embodiment the pin and box thread leaves a gap in which the ring or segments 20 reside and relative rotation during milling is foreclosed with the torque applied to the thread 14 on makeup. Ring or segments 20 can also extend partially into pin 26 as indicated by hidden lines 28 for a rotational lock not dependent on the makeup torque of thread 14.

Figure 2:
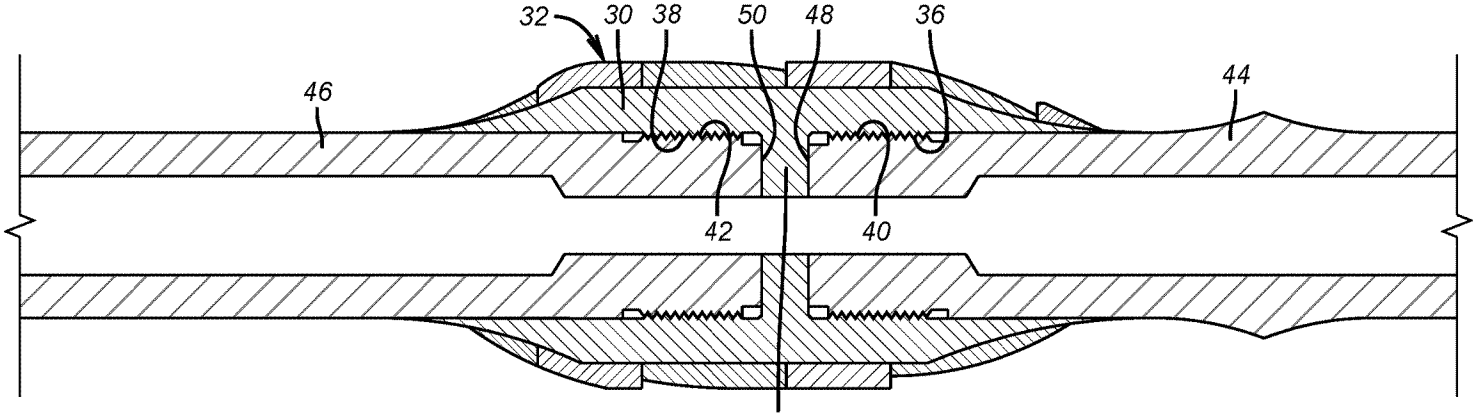
FIG. 2 is a section view where a sleeve with a cutting structure acts as a coupling for threaded mandrel components.

The FIG. 2 design still has the removable sleeve 30 on which is mounted the cutting structure 32 and an internal ring or segments 34 but in this embodiment there are threads 36 and 38 that engage threads 40 and 42 that respectively are on mandrel components 44 and 46. When the spaced threaded connections are made up to the required torque the ring or segments 34 are trapped between surfaces 48 and 50 so that sleeve 30 is held in position without relative rotation with respect to the components 44 and 46. In this configuration other forms of rotational locking as described for the FIG. 1 configuration become more difficult. On the other hand, the advantages of the flexibility of the connection to flexing and the absence of stress concentration locations at welds are still present. The sleeve 30 acts similar to a threaded coupling in bringing components 44 and 46 together to pinch the ring or segments 34 for axial fixation as in FIG. 1 and also to preclude relative rotation due to force imparted from surfaces 48 and 50 when the components 44 and 46 are properly torqued on makeup.

Figure 3:
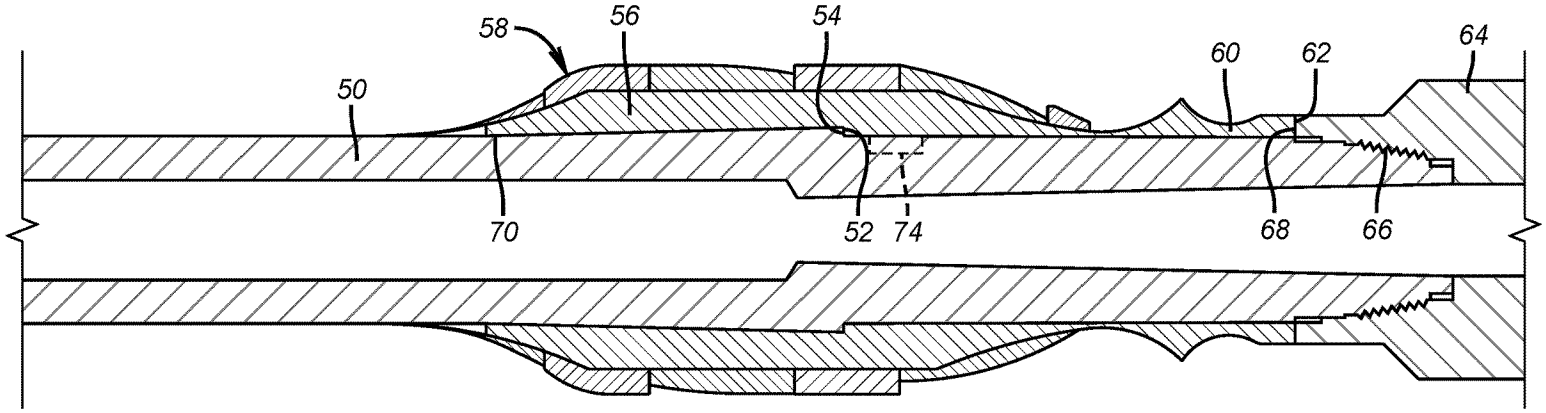
FIG. 3 is a section view of a mandrel shoulder acting with a sleeve held in position by a window mill retains the cutting structure sleeve in an axial direction.

FIG. 3 is a variation of the other two designs in that a one piece mandrel 50 is employed with a radial shoulder or some other form of travel stop 52 to catch an opposing shoulder or travel stop 54 on sleeve 56 that has the cutting structure 58. What holds the sleeve 56 in position and is considered a mandrel component is a spacer sleeve 60 that has an end surface 62 that is abutted by a box 64 that is part of the window mill assembly (not shown) that is immediately downhole. When thread 66 is torqued to specification it drives surface 68 against surface 62 and in turn surface 54 against surface 52. As before the sleeve 56 is trapped against surface 52 in the axial direction. In this design, the sleeve 56 extends beyond an end of the cutting structure 58 and all the way to surface 62. Sleeve 56 can be a single piece or multiple parts from surface 68 to end 70. Dashed lines 74 depict an optional rotational lock of the sleeve 56 to the mandrel 50. This design enjoys the elimination of welding near the cutting structure 58 and a rapidly removable sleeve 56 as well as some enhanced flexibility to bending due to the manner in which the sleeve 56 is fixed to the mandrel 50 as described above.

Figure 4:
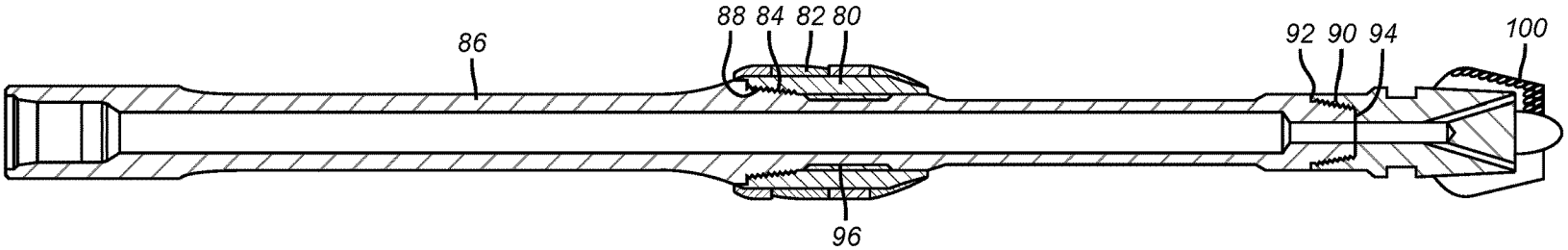
FIG. 4 is a section view of another embodiment using a threaded connection against a shoulder for the sleeve.

Referring to FIG. 4, a sleeve 80 has a cutting structure 82 and is secured by threads 84 to the mandrel 86. Sleeve 80 shoulders against shoulder 88 on mandrel 86. The size of threads 84 can be a smaller diameter than they otherwise would be because the thread 90 preferably has an exterior shoulder 92 and an interior shoulder 94 although a single shoulder is also contemplated. The presence of shoulders 92 and 94 allows higher torqueing on the connection and provides greater strength in the connection with a smaller diameter as compared to a situation where there are no shoulders in thread 90. Because the dimension at thread 90 is smaller the dimension at thread 84 can be correspondingly reduced. Bending is facilitated under the sleeve 80 with a recess 96 that preferably runs for the substantial length of the sleeve 80 that surrounds it. The recess 96 can be continuous for 360 degrees or segmented about the outer surface of the mandrel 86. Other approaches to making the mandrel 86 more flexible under the sleeve 80 are also contemplated. Some examples are axial slots, differing materials or an internal passage dimension change to list a few examples. The reduced diameter at the end of cutting structure 82 made possible by the shoulders 92 and 94 and the smaller mandrel 86 reduces damage to the end of the cutting structure 82 of the watermelon mill as it engages the lower end of the window created by the window mill 100. Failures at the threads 90 or 84 are less likely at the time the watermelon mill is forced laterally through the newly created window. Shoulder 88 with thread 84 are all that is needed to retain the sleeve 80 to the mandrel 86 without use of external retaining sleeves such as in the FIG. 3 embodiment where the addition of the retaining sleeves makes the assembly somewhat less flexible for a window exit.

While the focus of the various designs has been a watermelon mill the design concepts are applicable to other types of mills or drill bits to name a few examples. One advantage of the ability to disassemble and redress quickly saves costs on inventory and allows rapid reuse of the same mill for further milling. The cutting structure that is spent is retrieved and is not simply released to fall in the hole like some very early designs of mills with cutting structures that released and dropped in the hole. The multiple piece mandrel adds flexibility while retaining the required strength for milling and thus minimizes if not eliminates stress failures from bending while milling. The elimination of welding on the mandrel also reduces stress concentration failures near welded zones.

The above description is illustrative of the preferred embodiment and many modifications may be made by those skilled in the art without departing from the invention whose scope is to be determined from the literal and equivalent scope of the claims below:

We claim:

1. A milling tool for subterranean use, comprising:

a mandrel having a mandrel axis and multiple selectively separable components;

a sleeve having a sleeve axis coinciding with said mandrel axis, said sleeve surrounding and removably mounted with separation of said mandrel components within said sleeve to said mandrel and further comprising a cutting structure fixed on an outer surface thereof, said cutting structure having a cutting structure axis aligned with said mandrel axis, and said cutting structure adapted to enlarge a window in a wall of a tubular;

said mandrel, said sleeve and said cutting structure on the outer surface of said sleeve all rotate in tandem.

2. The tool of claim 1, wherein:

said mandrel retains said sleeve from shifting axially.

3. The tool of claim 1, wherein:

said mandrel retains said sleeve from relatively rotating with respect to said mandrel.

4. The tool of claim 1, wherein:

said mandrel is secured to each other with a thread.

5. The tool of claim 4, wherein:

said sleeve comprising an extending member retained on said mandrel.

6. The tool of claim 5, wherein:

said extending member engaging a recess on one part of said mandrel for rotational locking as another part of said mandrel is rotated to make up said thread.

7. The tool of claim 5, wherein:

said components squeeze said extending member in opposed axial directions for fixation of said sleeve.

8. The tool of claim 5, wherein:

said extending member is retained under said sleeve and adjacent said thread that holds components of said mandrel to each other.

9. The tool of claim 5, wherein:

said extending member comprises a continuous or segmented ring or spaced lugs extending from an inner surface of said sleeve.

10. The tool of claim 1, wherein:

said mandrel, sleeve and cutting structure flexibly bend without relative rotation when cutting through the tubular to make the window.

11. The tool of claim 1, wherein:

said mandrel has a thread with an adjacent shoulder at an end thereof.

12. A milling tool for subterranean use, comprising:

a mandrel having a mandrel axis and at least one component;

a sleeve having a sleeve axis coinciding with said mandrel axis, said sleeve surrounding and removably mounted to said mandrel and further comprising a cutting structure fixed on an outer surface thereof, said cutting structure having a cutting structure axis aligned with said mandrel axis, and said cutting structure adapted to enlarge a window in a wall of a tubular;

said mandrel, said sleeve and said cutting structure on the outer surface of said sleeve all rotate in tandem;

said mandrel are secured to said sleeve with threads.

13. The tool of claim 12, wherein:

said sleeve comprising an extending member retained on said mandrel.

14. The tool of claim 13, wherein:

said mandrel comprising components that squeeze said extending member in opposed axial directions for fixation of said sleeve.

15. The tool of claim 13, wherein:

said extending member is retained between spaced threads on said sleeve.

16. The tool of claim 13, wherein:

said extending member comprises a continuous or segmented ring or spaced lugs extending from an inner surface of said sleeve.

17. A milling tool for subterranean use, comprising:

a mandrel having a mandrel axis and at least one component;

a sleeve having a sleeve axis coinciding with said mandrel axis, said sleeve surrounding and removably mounted to said mandrel and further comprising a cutting structure fixed on an outer surface thereof, said cutting structure having a cutting structure axis aligned with said mandrel axis, and said cutting structure adapted to enlarge a window in a wall of a tubular;

said mandrel, said sleeve and said cutting structure on the outer surface of said sleeve all rotate in tandem;

said mandrel is more flexible to bend under said sleeve than on either side of said sleeve.

18. The tool of claim 17, wherein:

said mandrel has a passage therethrough with a larger dimension for said passage under said sleeve for flexibility under said sleeve than the dimension of said passage at other portions of said mandrel away from said sleeve.

19. A method of milling a tubular wall at a subterranean location, comprising:

providing a mandrel comprising multiple selectively separable components and a mandrel axis;

removably mounting a sleeve surrounding said mandrel, said sleeve further comprising a cutting structure fixed on an outer surface thereof, wherein said sleeve is removable by separation of said selectively separable components from within said sleeve;

aligning a cutting structure axis with said mandrel axis, said cutting structure adapted to enlarge a window in a wall of a tubular;

connecting said mandrel, said sleeve and said cutting structure on the outer surface of said sleeve to rotate in tandem;

cutting with said cutting structure.

* * * * *